US006981348B2

(12) United States Patent
Kjorsvik

(10) Patent No.: US 6,981,348 B2
(45) Date of Patent: Jan. 3, 2006

(54) FLASHING FOR AN EXTERIOR ARCHED SURFACE AND METHOD

(76) Inventor: Dale Kjorsvik, P.O. Box 973, Duvall, WA (US) 98019

( * ) Notice: Subject to any disclaimer, the term of this patent is extended or adjusted under 35 U.S.C. 154(b) by 0 days.

(21) Appl. No.: 10/638,020

(22) Filed: Aug. 8, 2003

(65) Prior Publication Data

US 2004/0031210 A1 Feb. 19, 2004

Related U.S. Application Data

(60) Provisional application No. 60/404,172, filed on Aug. 15, 2002.

(51) Int. Cl.
*E04G 15/02* (2006.01)

(52) U.S. Cl. ..... 52/85; 52/741.3; 52/211; 52/86; 52/255; 52/717.01

(58) Field of Classification Search ..... 52/58, 52/62, 85–88, 285, 256, 257, 364, 371, 86, 52/287.1, 79.1, 79.4, 82, 717.01, 717.04, 52/254, 255, 211, 741.3; 135/16, 19, 98, 135/106

See application file for complete search history.

(56) References Cited

U.S. PATENT DOCUMENTS 2,242,438 A * 5/1941 Adolph ..... 428/88
3,008,273 A * 11/1961 Felix ..... 52/85
5,291,717 A * 3/1994 Turner ..... 52/745.07
5,572,834 A * 11/1996 Lilly ..... 52/85
5,671,583 A * 9/1997 Turner ..... 52/745.16
5,699,638 A * 12/1997 Maylon ..... 52/86
5,735,035 A * 4/1998 Holt ..... 29/527.2
6,094,977 A * 8/2000 Vaughn ..... 73/121
6,401,401 B1 6/2002 Williams ..... 52/58
6,457,279 B1 10/2002 Jacobsen et al. ..... 52/58
6,502,353 B2 1/2003 Hofmann ..... 52/58
6,503,601 B1 1/2003 Edvardsen ..... 428/174

OTHER PUBLICATIONS

Construction Dictionary, Bni, 2001, BNi Publications, Inc. 319.*

* cited by examiner

*Primary Examiner*—Naoko Slack
(74) *Attorney, Agent, or Firm*—Dean A. Craine

(57) ABSTRACT

Flashing used on curved exterior wall projections designed to stop water intrusion and provide a permanent, attractive, paintable surface that is safe from UV radiation. The flashing includes a Z-shaped or L-shaped body bonded with a flexible flashing material along its front and back surface. The metal body includes at least two perpendicularly aligned flange members. Formed on the top flange member is a plurality of transversely aligned slits evenly spaced thereon that allow the flashing to be bent around a curved wall projection. The flexible flashing material is adhesively bonded to the inside and outside surfaces of the top flange member thereby covering the slits to create a water barrier. During installation, the top flange member and flexible flashing material are covered by external wallboards or siding.

1 Claim, 2 Drawing Sheets

FLASHING FOR AN EXTERIOR ARCHED SURFACE AND METHOD

This is a utility patent application which claims benefit of U.S. Provisional Application No. 60/404,172 filed on Aug. 15, 2002.

BACKGROUND OF THE INVENTION

1. Field of the Invention

This invention pertains to exterior flashing and, more particularly, to such flashing designed for use around curved exterior wall projections.

2. Description of the Related Art

Z- or L-shaped metal flashing is commonly used in the building industry to prevent the intrusion of water through a joint on an exterior wall projection, such as a windowsill or doorframe. Around curved exterior wall projections, slits or V-shaped cutouts are made on the flange members that enable the flashing to be bent around a curved surface. Also, flexible flashing made of rubber, latex, or asphalt-based material has been used that bends around a curved surface. One drawback with Z- or L-shaped flashing is that rainwater is able to travel through the slits or cutouts. One drawback with flexible flashing material is that it slowly deteriorates when exposed to ultraviolet light.

What is needed is a flashing made for an arched surface that is attractive and paintable; can be easily bent around the top surface of the arched surface; does not allow the intrusion of water; and, does not deteriorate when exposed to ultraviolet radiation.

SUMMARY OF THE INVENTION

It is an object of the present invention to provide an attractive and paintable flashing for an arched wall projection.

It is another object of the present invention to provide such a flashing that prevents the intrusion of water.

It is a further object of the present invention to provide such a flashing when properly installed around an arched wall projection that does not deteriorate with exposure to ultraviolet radiation.

These and other objects of the present invention are met by a flashing specifically designed for use on an exterior arched wall projection that stops water intrusion and is resistant to damage caused by UV radiation. The flashing includes a Z-shaped or L-shaped body with a flexible flashing material adhesively attached to its back surface. In the preferred embodiment, the body includes a top flange member and an intermediate flange member. The top flange member is relatively wide and includes a plurality of transversely aligned slits evenly spaced thereon that allow the intermediate flange member to be bent around a curved or arched wall projection. In the preferred embodiment, the slits extend partially and transversely over the top flange member thereby leaving a small portion of the top flange member uncut. As the intermediate flange member is bent in a direction opposite the top flange member around an arched wall projection, the slits' opening widen so that the intermediate flange member may smoothly conform in shape to the adjacent arched wall projection. In a second embodiment, that flashing includes a lower flange member perpendicularly aligned with the intermediate flange member and opposite the top flange member. In both embodiments, flexible flashing material is adhesively bonded to the inside surfaces of the top, intermediate, and lower flange members and extends over the outside surface of the top flange member to completely cover the slits and the expanded slit openings. Because the top flange member is typically placed under wall siding, the section of flexible flashing material that covers the slits and slit openings is protected from ultraviolet radiation. The exposed portion of the top flange member is attractive and may be easily painted.

Using the above flashing, a method of protecting an arched wall projection is also provided.

DESCRIPTION OF THE PREFERRED EMBODIMENT(S)

Figure 1:
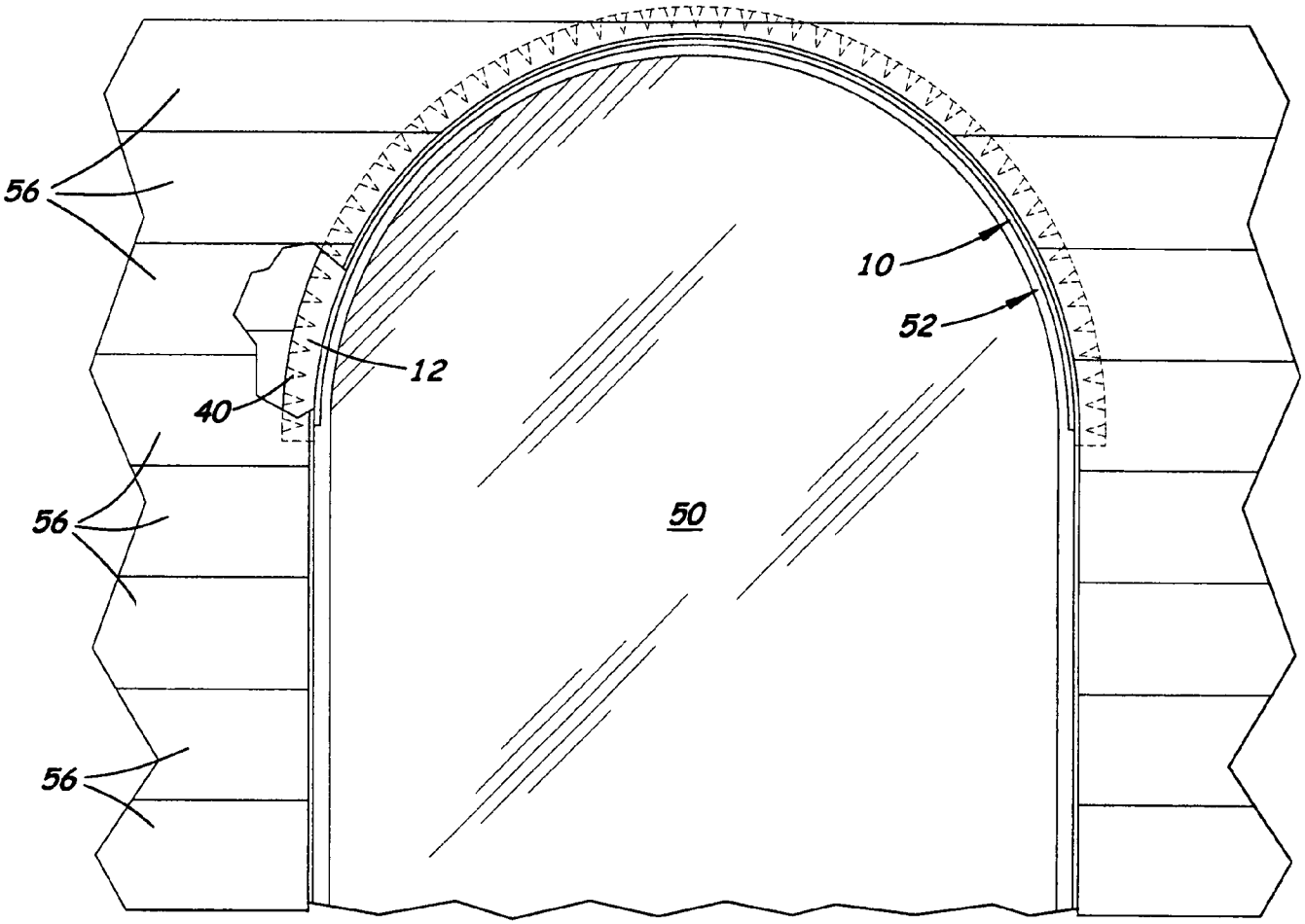
FIG. 1 is a front elevation view of an arched window with the flashing disclosed herein attached to its outer surface.
Figure 2:
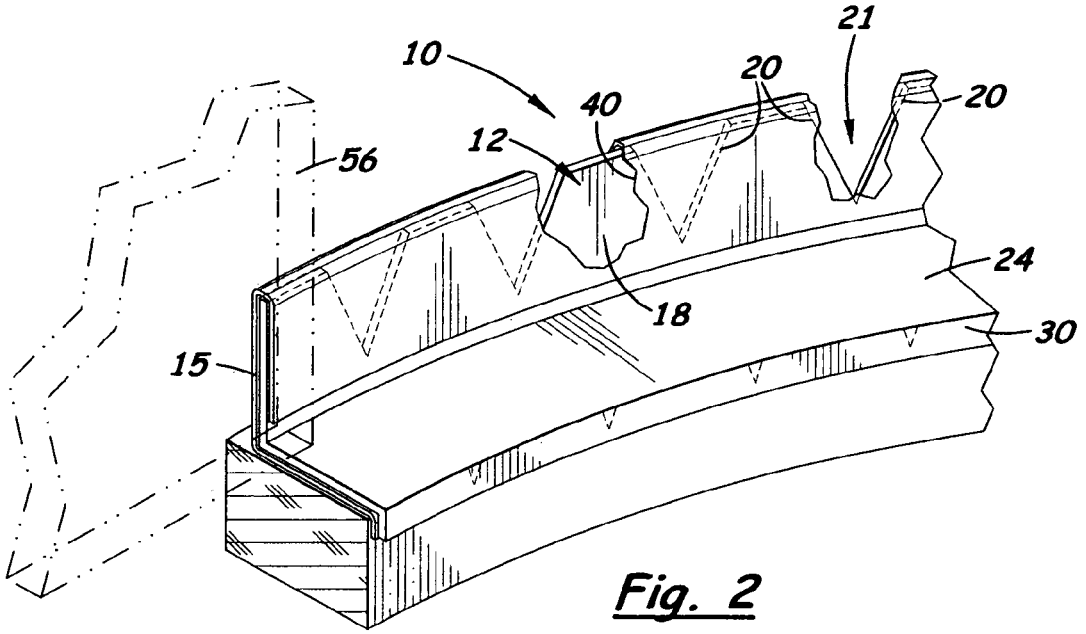
FIG. 2 is a perspective view of a section of an arched window showing the flashing.
Figure 4:
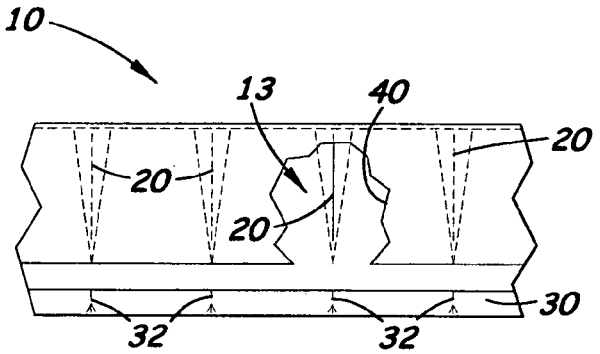
FIG. 4 is a front elevation view of a section of the flashing.
Figure 3:
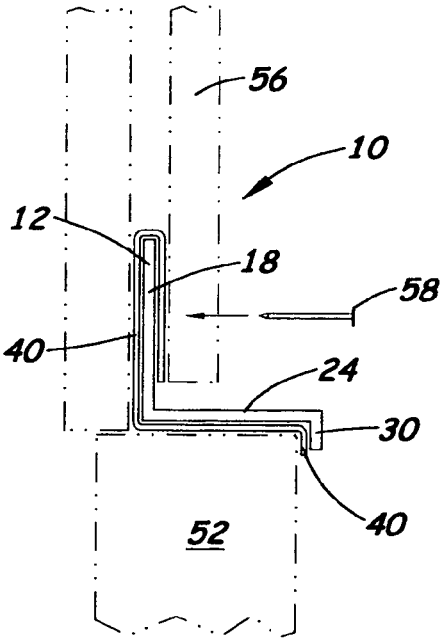
FIG. 3 is a side elevation view of the invention shown in FIG. 2.
Figure 5:
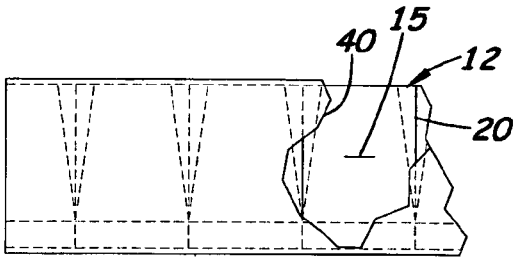
FIG. 5 is a rear elevation view of a section of the flashing.

Shown in the accompanying FIGS. 1–5, there is shown a flashing 10 specifically designed for use on an exterior arched or curved wall projection 52 that stops water intrusion and provides a permanent, attractive, paintable surface that is safe from UV radiation. The flashing 10 includes a metal body 12 with flexible flashing material 40 bonded to its entire back surface 13 and a portion of its front surface 15. In the preferred embodiment, the metal body 12 is Z-shaped with top, intermediate and lower flange members 18, 24, 30, respectively. The top flange member 18 includes a plurality of transversely aligned slits 20 evenly spaced and formed thereon that allow the metal body 12 to be continuously bent in the direction toward the lower flange member 30 for placement around an existing curved or arched wall projection 52 commonly found around a window 50. The slits 20 are slightly shorter in length than the width of the top flange member 18 thereby creating a continuous, non-cut section located adjacent to the corner between the top flange member 18 and the intermediate flangemember 24.

When the intermediate flange member 24 is bent in a direction opposite the top flange member 18, the slits 20 open. Also formed on the lower flange member 30 are optional slits 32 designed also to allow the metal body 12 to bend in the same direction as the top flange member 18. The flexible flashing material 40 is adhesively bonded to the inside surfaces of the top, intermediate, and lower flange members 18, 24, 30, respectively, and extends slightly over the outside surface of the top flange member 18.

In the preferred embodiment, the flexible flashing material 40 is a non-woven, rubber or polyester core with a self-adhering asphalt layer approximately 30 to 50 mils thick. The metal body 12 is made of steel approximately 50 to 100 mils thick. The width and length of the top flange member 18, intermediate member 24 and lower flange member 30 can vary depending on the application.

During use, the metal body 12 is positioned around a curved wall projection 52 so that the intermediate flange member 24 covers the horizontal surface on the curved wall projection 52. The top flange member 18 is positioned against the adjacent vertical wall surface and attached thereto with nails 58 or suitable connections. As the intermediate flange member 24 is bent around the curved wall projection 52, the size of the slits 20 are adjusted. Exterior wall boards 56 are lapped over the top flange member 18 to protect the flexible flashing material 40 from ultraviolet radiation.

Using the above flashing, a method of protecting an exterior arched wall projection 52 is also provided:

a. selecting a flashing 10 that includes a body 12 with a top flange member 18 and a perpendicularly aligned intermediate flange member 24, said top flange member 18 including a plurality of transversely aligned slits 20 formed thereon, a flexible flashing material 40 bonded over the inside and outside surfaces of said top flange member 18 thereby covering said slits 20;

b. positioning said flashing 10 over a curved wall projection 52 so that said intermediate flange member 24 is adjacent to the curved wall projection 52 and said top flange member 18 is position adjacent to a wall perpendicularly aligned with said curved wall projection 52, said curved wall projection 52 being curved in a direction opposite to top flange member 18 so that said slits 20 open when said intermediate flange member 24 is bent around said curved wall projection 52;

c. securing the flashing 10 over said curved wall projection 52; and, d. attaching exterior wall boards 56 over said top flange member 18.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A method of protecting a projecting curved surface, comprising the following steps:

a. selecting a flashing that includes a metal body with a top flange member and a intermediate flange member, said top flange member including a plurality of slits formed thereon that enable said intermediate flange member to be bent over a projecting curved surface in a direction opposite said top flange member, said flashing including a layer of flexible flashing material bonded over the inside and outside surfaces of said top flange member that covers said slits;

b. positioning said top flange surface adjacent to a wall surface perpendicularly aligned with a curved surface;

c. bending said intermediate flange member over said curved surface, said bending movement causing said slits on said top flange member to widen;

d. securing said flashing over said curved surface; and, e. attaching exterior wall boards over said top flange member, and said flexible flashing material located thereon to prevent sunlight exposure of said flexible flashing material.

* * * * *